US006780128B2

(12) United States Patent
Moriyama et al.

(10) Patent No.: US 6,780,128 B2
(45) Date of Patent: Aug. 24, 2004

(54) GOLF BALL

(75) Inventors: Keiji Moriyama, Kobe (JP); Takahiro Sajima, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/986,401

(22) Filed: Nov. 8, 2001

(65) Prior Publication Data

US 2002/0119838 A1 Aug. 29, 2002

(30) Foreign Application Priority Data

Dec. 22, 2000 (JP) ..... 2000-390462

(51) Int. Cl.[7] ..... A63B 37/12
(52) U.S. Cl. ..... 473/383
(58) Field of Search ..... 473/378–384

(56) References Cited

U.S. PATENT DOCUMENTS 4,762,326 A * 8/1988 Gobush ..... 473/380
4,813,677 A 3/1989 Oka et al.
4,848,766 A * 7/1989 Oka et al. ..... 473/384
4,936,587 A 6/1990 Lynch et al.
5,080,367 A 1/1992 Lynch et al.
5,292,132 A 3/1994 Oka
5,433,447 A * 7/1995 Pocklington ..... 473/377
5,776,013 A * 7/1998 Yokota et al. ..... 473/377
6,319,155 B1 11/2001 Moriyama et al.
6,346,053 B1 2/2002 Inoue et al.

FOREIGN PATENT DOCUMENTS

GB 1 508 039 4/1978

* cited by examiner

*Primary Examiner*—Raeann Gorden
(74) *Attorney, Agent, or Firm*—Birch, Stewart, Kolasch & Birch, LLP

(57) ABSTRACT

A golf ball has a large number of dimples (A dimples and B dimples) on a surface thereof. X and Y satisfy a relationship of an equation (I):

$$X \leqq 388219\,Y + 1495 \qquad \text{(I)},$$

X representing a total of dimple contour lengths x and Y representing a surface area occupation ratio of the dimples. The surface area occupation ratio Y of the golf ball is 0.70 to 0.90. The number of dimples having the dimple contour length x of 10.5 mm or more is 91% of a total number of the dimples or more.

7 Claims, 18 Drawing Sheets

GOLF BALL

BACKGROUND OF THE INVENTION

1. Field of the Invention

The present invention relates to a golf ball and more particularly to an improvement in a dimple pattern of the golf ball.

2. Description of the Related Art

A golf ball has approximately 200 to 550 dimples on a surface thereof. The role of the dimples resides in one aspect that such dimples disturb an air stream around the golf ball during the flight of the golf ball to accelerate the transition of a turbulent flow at a boundary layer, thereby causing a turbulent flow separation (which will be hereinafter referred to as a "dimple effect"). The acceleration of the transition of the turbulent flow causes a separating point of air from the golf ball to be shifted backward so that a drag coefficient (Cd) is reduced, resulting in an increase in the flight distance of the golf ball. Moreover, the acceleration of the transition of the turbulent flow increases a differentia between upper and lower separating points of the golf ball which is caused by a back spin. Consequently, a lift acting on the golf ball is increased.

There have been proposed various golf balls having improved dimple patterns in order to enhance a flight performance. For example, Japanese Patent Publication No. Sho 58-50744 (1983/50744) (U.S. Pat. No. 4,936,587 and U.S. Pat. No. 5,080,367) has disclosed a golf ball in which dimples are densely provided such that a pitch between the dimples is 1.62 mm or less if possible. Moreover, Japanese Unexamined Patent Publication No. Sho 62-192181 (1987/192181) (U.S. Pat. No. 4,813,677) has disclosed a golf ball in which dimples are densely provided so as not to form a new dimple having an area which is equal to or larger than a mean area in a land portion other than the dimples. Furthermore, Japanese Unexamined Patent Publication No. Hei 4-347177 (1992/347177) (U.S. Pat. No. 5,292,132) has disclosed a golf ball in which dimples are provided very densely such that the number of land portions in which a rectangle having a predetermined dimension can be drawn is 40 or less.

All the golf balls disclosed in the publications have dimples provided densely, in other words, the surface area occupation ratio of the dimples is increased. The person skilled in the art has recognized that the surface area occupation ratio is one of important elements to influence a dimple effect.

However, the surface area occupation ratio is not the only index to guess the dimple effect. In order to further enhance the flight performance, an improvement in a dimple pattern is to be investigated together with the surface area occupation ratio in other respects.

SUMMARY OF THE INVENTION

The present inventors have taken note of a total length of dimple contours (hereinafter referred to as a "total contour length") in addition to the surface area occupation ratio as an important element to influence the dimple effect. The present inventors have found that a smaller total contour length tends to be more excellent in a flight performance if the surface area occupation ratio is equal in an existing golf ball. By setting the relationship between the surface area occupation ratio and the total contour length to a range which cannot be obtained by the existing golf ball, the flight performance could be enhanced.

The present invention provides a golf ball having a large number of dimples on a surface thereof, wherein X and Y satisfy a relationship of an equation (I):

$$X \leqq 3882 \cdot Y + 1495 \quad \text{(I)},$$

X representing a total of dimple contour lengths x and Y representing a surface area occupation ratio of the dimples.

The golf ball having the total contour length X and the surface area occupation ratio Y to satisfy the equation (I) comprises a dimple pattern having the small total contour length X for the surface area occupation ratio Y. The reason why the flight performance of the golf ball is excellent is not clear in detail. It is guessed that the dimple pattern contributes to a reduction in a drag coefficient (Cd), particularly, a reduction in the drag coefficient (Cd) in a high-speed region immediately after hitting.

It is preferable that the surface area occupation ratio Y should be 0.70 to 0.90. Consequently, the flight performance of the golf ball can further be enhanced.

It is preferable that the number of dimples having the contour length x of 10.5 mm or more should be 91% of the total number of the dimples or more. Consequently, the flight performance of the golf ball can be enhanced still more.

DESCRIPTION OF THE PREFERRED EMBODIMENTS

The present invention will be described below in detail based on a preferred embodiment with reference to the drawings.

Figure 1:
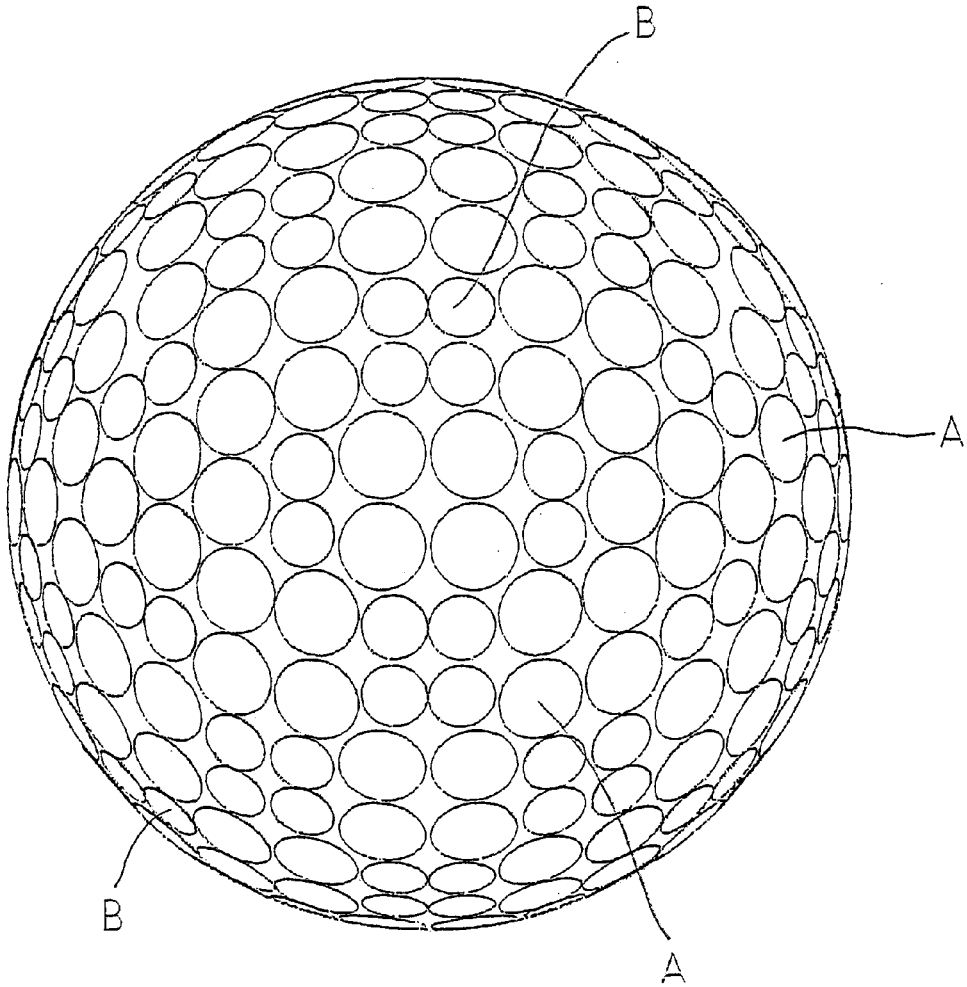
FIG. 1 is a plan view showing a golf ball according to an embodiment of the present invention.
Figure 2:
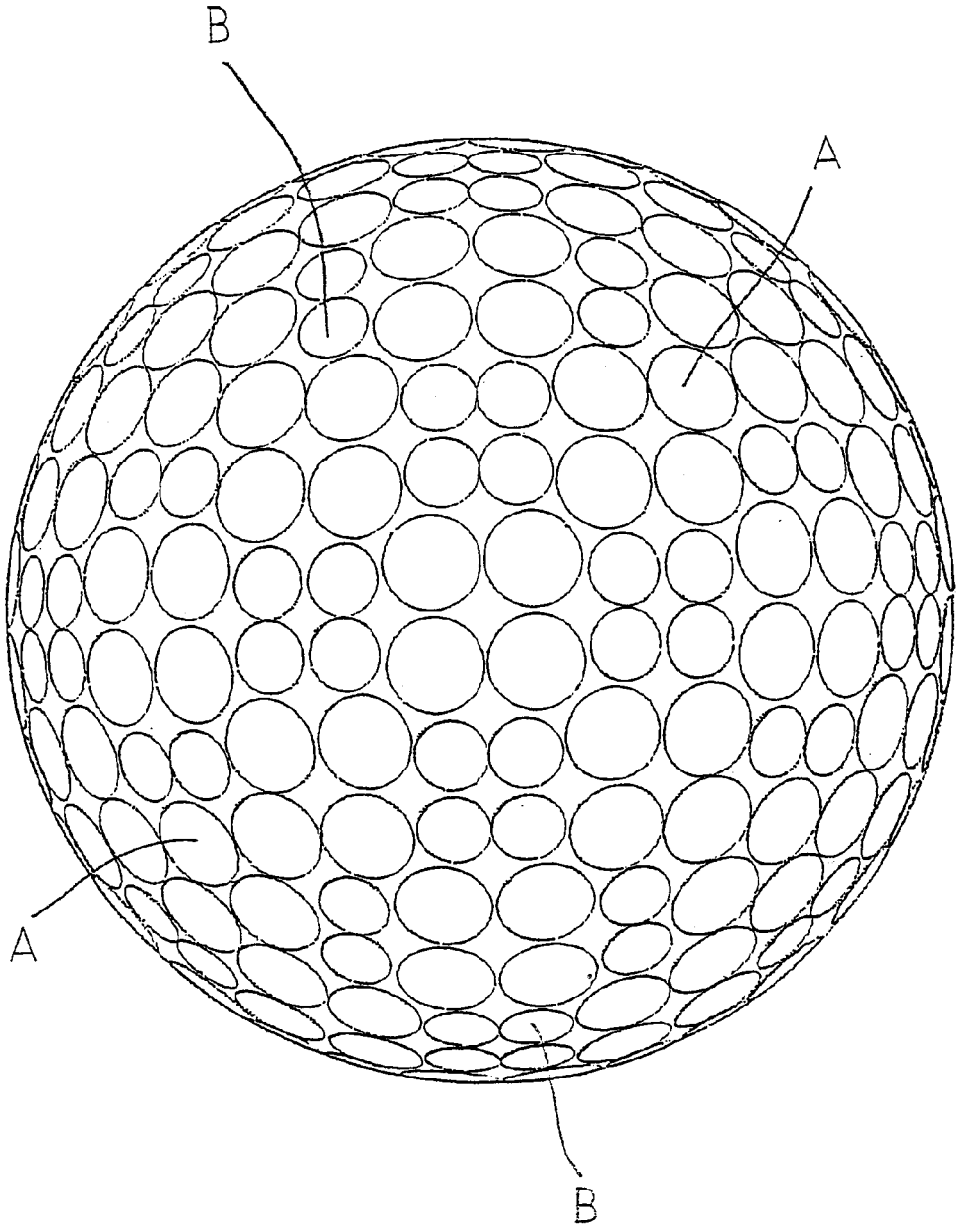
FIG. 2 is a front view showing the golf ball in FIG. 1.

FIG. 1 is a plan view showing a golf ball according to an embodiment of the present invention and FIG. 2 is a front view showing the golf ball. The golf ball usually has a diameter of approximately 42.67 mm to 43.00 mm. The golf ball includes an A dimple having a circular plane shape and a diameter of 4.5 mm and a B dimple having a circular plane shape and a diameter of 3.5 mm. The number of the A dimples is 192 and that of the B dimples is 144. Accordingly, the total number of the dimples of the golf ball is 336.

Figure 3:
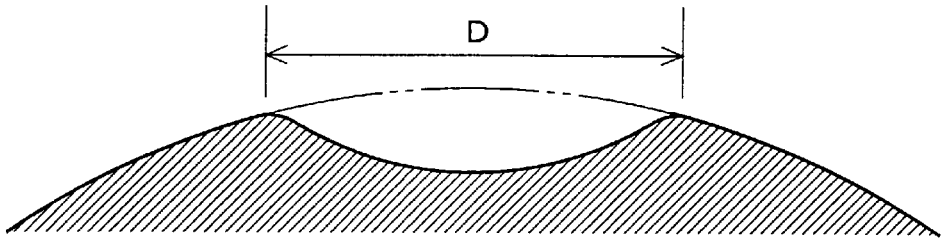
FIG. 3 is a typical enlarged sectional view showing a part of the golf ball in FIG. 1.

FIG. 3 is a typical enlarged sectional view showing a part of the golf ball in FIG. 1. FIG. 3 shows a section taken along the deepest portion of the dimple. In FIG. 3, the diameter of the dimple is shown in an arrow D. The diameter D represents a distance between both contacts when a common tangential line is drawn on both ends of the dimple. Moreover, a dimple volume represents the volume of a portion surrounded by the virtual sphere of the golf ball (which is a sphere on the assumption that the dimple is not present and is shown in a two-dotted line of FIG. 3) and the surface of the dimple.

A contour length x of the dimple represents a length measured along the contour of the dimple. For example, in the case in which the dimple has a triangular plane shape, the total length of three sides is represented by the contour length x. Since these sides are present on a spherical surface, they are not straight lines but circular arcs in a strict sense. The length of the circular arc is set to be the length of the side. In the case of a circular dimple, the contour length x is calculated by the following equation.

$$x=D\cdot\pi$$

In the golf ball shown in FIG. 1, the A dimple has a diameter D of 4.5 mm as described above. Accordingly, the A dimple has a contour length x of 14.1 mm. Since the B dimple has a diameter D of 3.5 mm, it has a contour length x of 11.0 mm. A total contour length X to be the sum of the contour lengths x is 4297.7 mm.

The area of the dimple represents the area of a region surrounded by the contour of the dimple (that is, the area of a planar shape) when the center of the golf ball is seen at infinity. In the case of the circular dimple, an area S is calculated by the following equation.

$$S=(D/2)^2\cdot\pi$$

In the golf ball shown in FIG. 1, the A dimple has an area of 15.9 $mm^2$ and the B dimple has an area of 9.6 $mm^2$. Accordingly, the sum of the dimple areas is 4435.2 $mm^2$. The sum is divided by the surface area of the virtual sphere so that a surface area occupation ratio Y is calculated. In the golf ball shown in FIG. 1, the surface area occupation ratio Y is 0.775.

Figure 4:
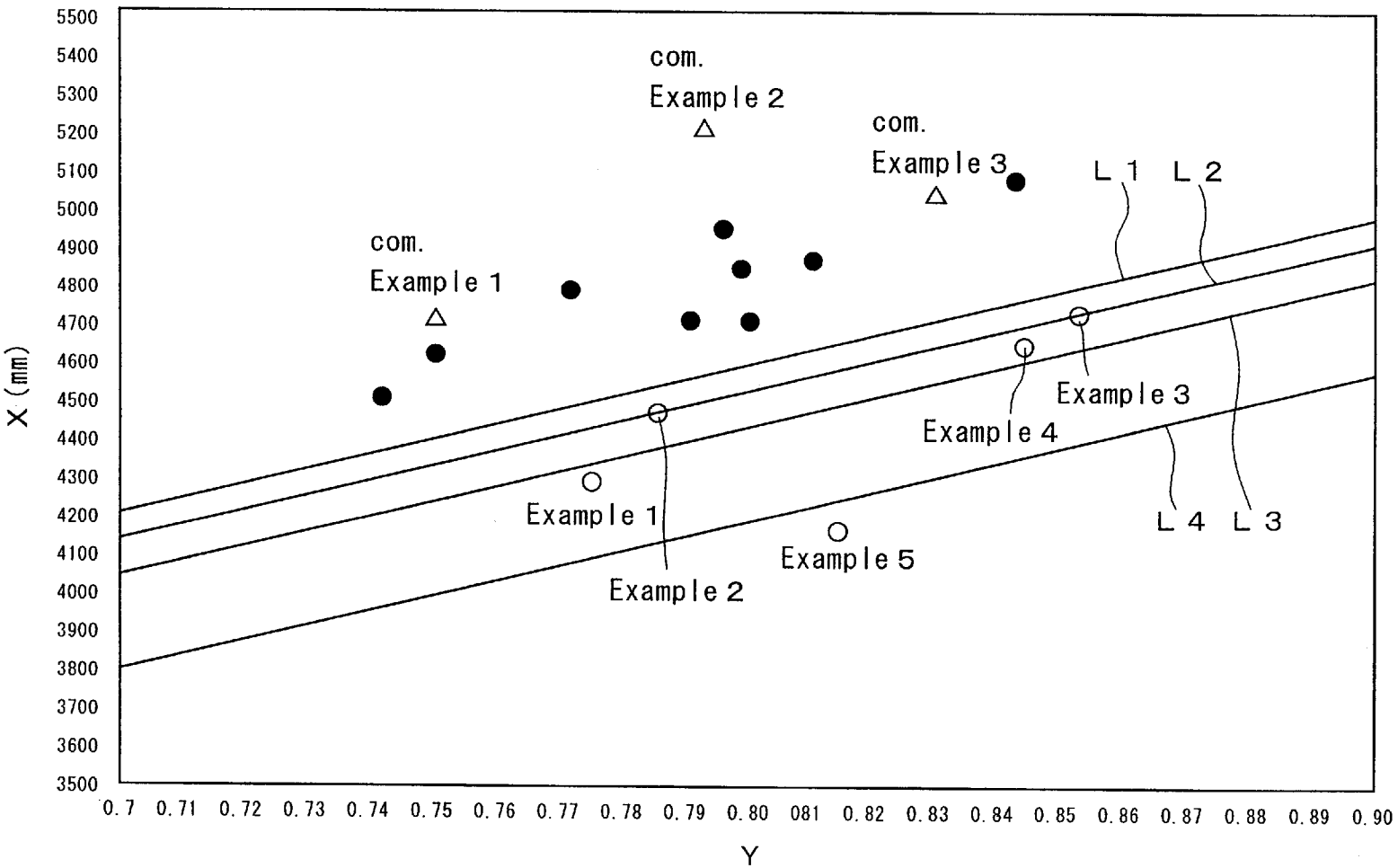
FIG. 4 is a graph showing the relationship between a total contour length X and a surface area occupation ratio Y.

FIG. 4 is a graph showing the relationship between the total contour length X and the surface area occupation ratio Y in the golf ball of FIG. 1. In the graph, an axis of ordinate indicates the total contour length X (mm) and an axis of abscissa indicates the surface area occupation ratio Y. The golf ball shown in FIG. 1 will also be described below in detail in an example 1, and a white circle indicated as "Example 1" in FIG. 4 corresponds to the golf ball.

A black circle in FIG. 4 corresponds to a conventional golf ball put on the market. A segment L1 is drawn to divide the graph into a region including the black circle and a region including no black circle. From the graph, the following equation for the segment L1 is obtained.

$$X=3882\cdot Y30\ 1495$$

More specifically, the lower region of the segment L1 (which includes the segment L1) satisfies the following equation (I).

$$X\leqq 3882\cdot Y+1495 \quad \text{(I)}$$

As long as the present inventors know, there has not conventionally been present a golf ball satisfying the equation (I) (that is, a golf ball in the lower region of the segment L1).

As is apparent from FIG. 4, the golf ball shown in FIG. 1 (the golf ball according to the example 1) is present in the lower region of the segment L1. More specifically, the golf ball has a small total contour length X for the surface area occupation ratio Y. The golf ball has a small drag coefficient (Cd) during a flight and is excellent in a flight performance.

A segment L2 is obtained by translating the segment L1 downward in parallel. From the graph, the following equation for the segment L2 is obtained.

$$X=3882\cdot Y+1445$$

More specifically, the lower region of the segment L2 (which includes the segment L2) satisfies the following equation (II).

$$X\leqq 3882\cdot Y+1445 \quad \text{(II)}$$

A segment L3 is obtained by translating the segment L1 more downward in parallel. From the graph, the following equation for the segment L3 is obtained.

$$X=3882\cdot Y+1335$$

More specifically, the lower region of the segment L3 (which includes the segment L3) satisfies the following equation (III).

$$X\leqq 3882\cdot Y+1335 \quad \text{(III)}$$

A segment L4 is obtained by translating the segment L1 further downward in parallel. From the graph, the following equation for the segment L4 is obtained.

$$X=3882\cdot Y+1085$$

More specifically, the lower region of the segment L4 (which includes the segment L4) satisfies the following equation (IV).

$$X\leqq 3882\cdot Y+1085 \quad \text{(IV)}$$

In respect of a reduction in the drag coefficient (Cd), it is preferable that the relationship between the total contour length X and the surface area occupation ratio Y should be close to a lower portion in the graph of FIG. 4. More specifically, the total contour length X and the surface area occupation ratio Y preferably satisfy the equation (II), more preferably the equation (III), and particularly preferably the equation (IV). The golf ball which is extremely close to the lower portion is hard to design as long as the original features of the golf ball to be an almost sphere are maintained. In an ordinary golf ball, accordingly, the total contour length X and the surface area occupation ratio Y satisfy the relationship of the equation (V).

$$X\geqq 3882\cdot Y+95 \quad \text{(V)}$$

Also in the case in which the total contour length X and the surface area occupation ratio Y satisfy the relationship of the equation (I), the lift of the golf ball might be insufficient during a flight if the surface area occupation ratio Y is extremely small. From this viewpoint, it is preferable that the surface area occupation ratio Y should be 0.70 or more, and particularly, 0.75 or more. Moreover, if the surface area occupation ratio Y is too high, a trajectory might be too high. Therefore, it is preferable that the surface area occupation ratio Y should be 0.90 or less.

In the case of the circular dimple, for example, when the diameter D is changed, the dimple contour length x is varied in proportion to the diameter D and the area S is varied in proportion to a square of the diameter D. In other words, the influence of the variation in the diameter D on the variation in the area S is greater than the influence of the variation in the diameter D on the variation in the dimple contour length x. In the case in which a designer is to design a dimple pattern having a high surface area occupation ratio Y, he (she) can use means for increasing the number of the dimples or the diameter D of the dimple to achieve the surface area occupation ratio Y. When the designer mainly employs the means for increasing the diameter D of the dimple to achieve the surface area occupation ratio Y, a golf ball having a small total contour length X for the surface area occupation ratio Y can be obtained. It is guessed that the dimple having a great diameter D contributes to a reduction in a drag coefficient (Cd) in a region having a high flight speed immediately after hitting.

In respect of a reduction in the drag coefficient (Cd), the number of dimples having a dimple contour length x of 10.5 mm or more is preferably 91% of the total number of the dimples or more, and particularly preferably 95% or more. The ratio is ideally 100%.

The total number of the dimples is preferably 200 to 500, and particularly preferably 250 to 400. If the total number is less than the range, it might be hard to cause the golf ball to take the shape of an almost sphere while maintaining a predetermined surface area occupation ratio Y (in other words, the smoothness of the surface of the golf ball might be damaged) If the total number is more than the range, the equation (I) might be satisfied with difficulty.

While the size of each dimple is not particularly restricted, the circular dimple usually has a diameter D of 2.0 mm to 8.0 mm, and particularly 3.0 mm to 7.0 mm. It is possible to form dimples of a simple kind or plural kinds. A non-circular dimple (a dimple having no circular plane shape) may be formed in place of the circular dimple or together with the circular dimple.

The sum of dimple volumes is preferably 300 $mm^3$ to 700 $mm^3$, and particularly 350 $mm^3$ to 600 $mm^3$. If the sum of the dimple volumes is less than the range, a trajectory might be too high. If the sum of the dimple volumes is more than the range, the trajectory might be dropped.

The total contour length X is properly determined based on the relationship with the surface area occupation ratio Y within the range to satisfy the equation (I), and is usually 2800 mm to 5000 mm, particularly, 3100 mm to 4700 mm.

The structure of the golf ball is not particularly restricted and a so-called wound golf ball or a solid golf ball (a one-piece golf ball, a two-pieces golf ball, a three-pieces golf ball or the like) may be used. Moreover, a material is not particularly restricted and a well-known material can be used.

EXAMPLES

Example 1

A core formed of a solid rubber was put in a mold and an ionomer resin composition was subjected to injection molding to form a cover around the core. The surface of the cover was coated so that a golf ball according to an example 1 which has a dimple pattern shown in a plan view of FIG. 1 and a front view of FIG. 2 was obtained. The golf ball had an outside diameter of approximately 42.70 mm, a weight of approximately 45.4 g, a compression of approximately 93 (by an ATTI compression tester produced by Atti Engineering Co., Ltd.) and a total dimple volume of 500 $mm^3$.

The golf ball includes 192 A dimples having a diameter of 4.5 mm and 144 B dimples having a diameter of 3.5 mm. The golf ball has a total contour length X of 4297.7 mm and a surface area occupation ratio Y of 0.775. Accordingly, the golf ball satisfies the equation (III). In the golf ball, moreover, the number of dimples having a dimple contour length x of 10.5 mm or more is 100% of the total number of the dimples.

Example 2

Figure 5:
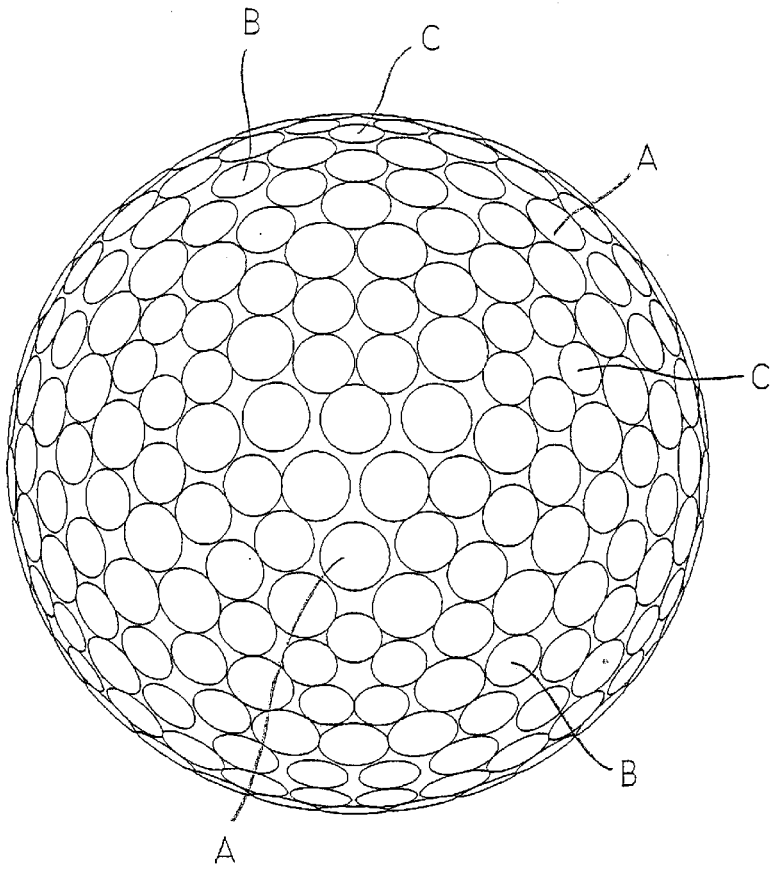
FIG. 5 is a plan view showing a golf ball according to an example 2 of the present invention.
Figure 6:
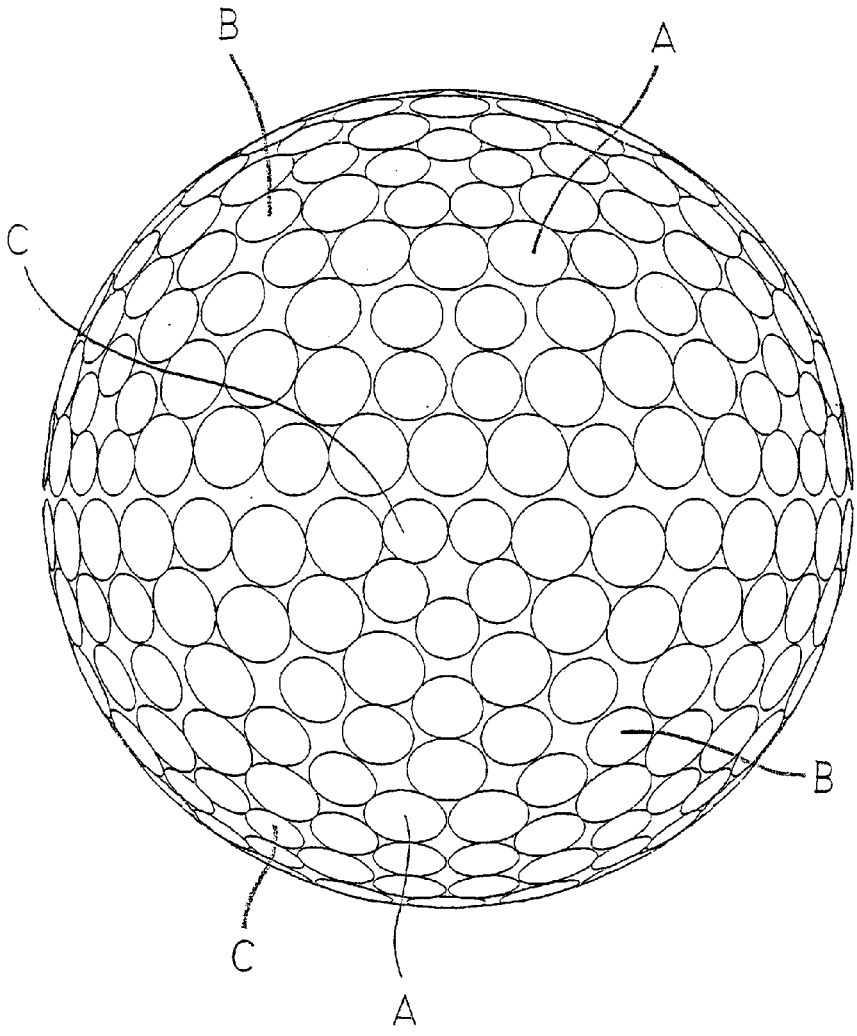
FIG. 6 is a front view showing the golf ball in FIG. 5.

A golf ball according to an example 2 which has a dimple pattern shown in a plan view of FIG. 5 and a front view of FIG. 6 was obtained in the same manner as in the example 1 except that the mold was changed. The golf ball includes 174 A dimples having a diameter of 4.3 mm, 126 B dimples having a diameter of 3.8 mm, and 60 C dimples having a diameter of 3.4 mm. The golf ball has a total contour length X of 4495.6 mm and a surface area occupation ratio Y of 0.786. Accordingly, the golf ball satisfies the equation (II). In the golf ball, moreover, the number of dimples having a dimple contour length x of 10.5 mm or more is 100% of the total number of the dimples.

Example 3

Figure 7:
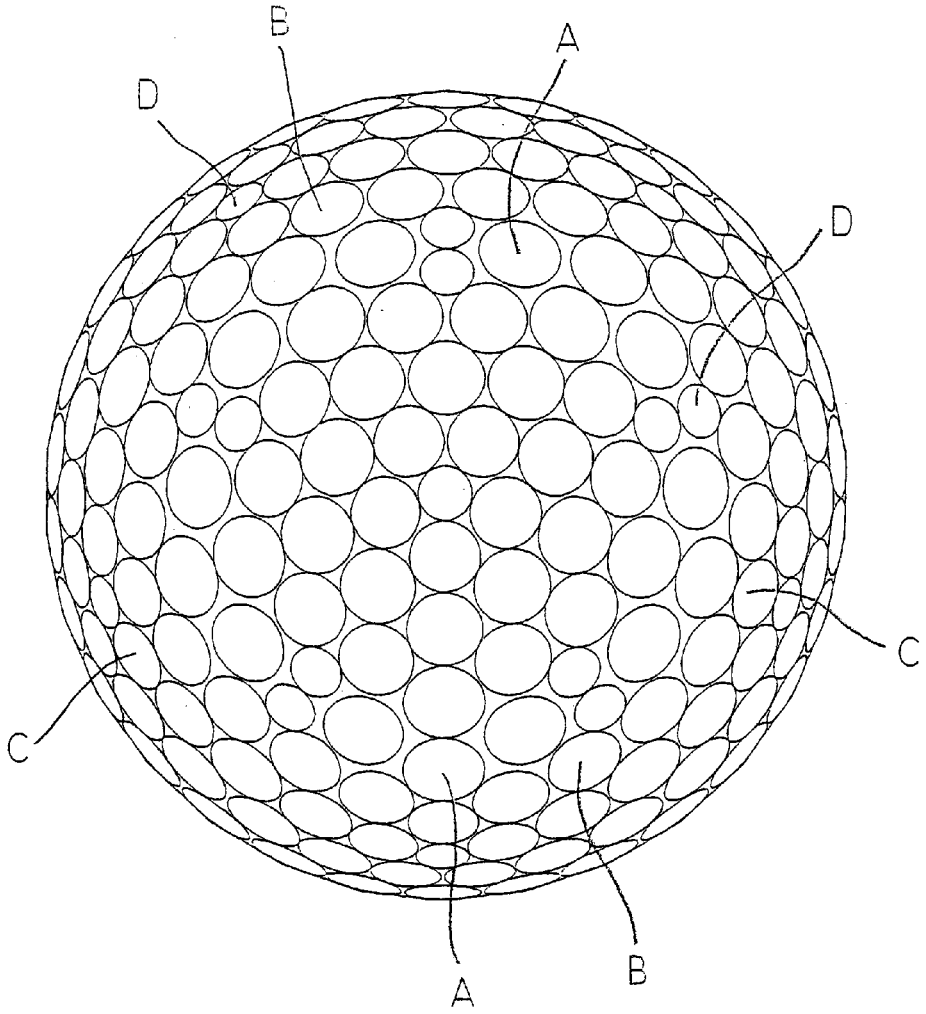
FIG. 7 is a plan view showing a golf ball according to an example 3 of the present invention.
Figure 8:
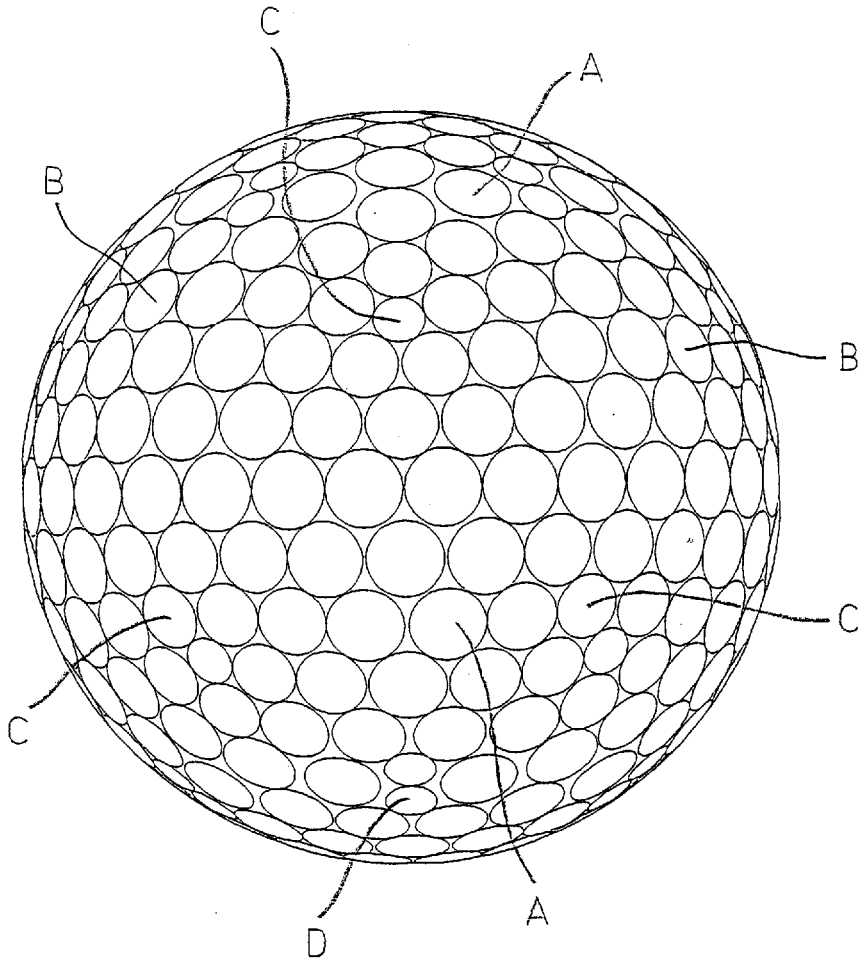
FIG. 8 is a front view showing the golf ball in FIG. 7.

A golf ball according to an example 3 which has a dimple pattern shown in a plan view of FIG. 7 and a front view of FIG. 8 was obtained in the same manner as in the example 1 except that the mold was changed. The golf ball includes 130 A dimples having a diameter of 4.4 mm, 150 B dimples having a diameter of 4.1 mm, 60 C dimples having a diameter of 3.9 mm, and 32 D dimples having a diameter of 2.9 mm. The golf ball has a total contour length X of 4755.7 mm and a surface area occupation ratio Y of 0.853. Accordingly, the golf ball satisfies the equation (II). In the golf ball, moreover, the number of dimples having a dimple contour length x of 10.5 mm or more is 91.4% of the total number of the dimples.

Example 4

Figure 9:
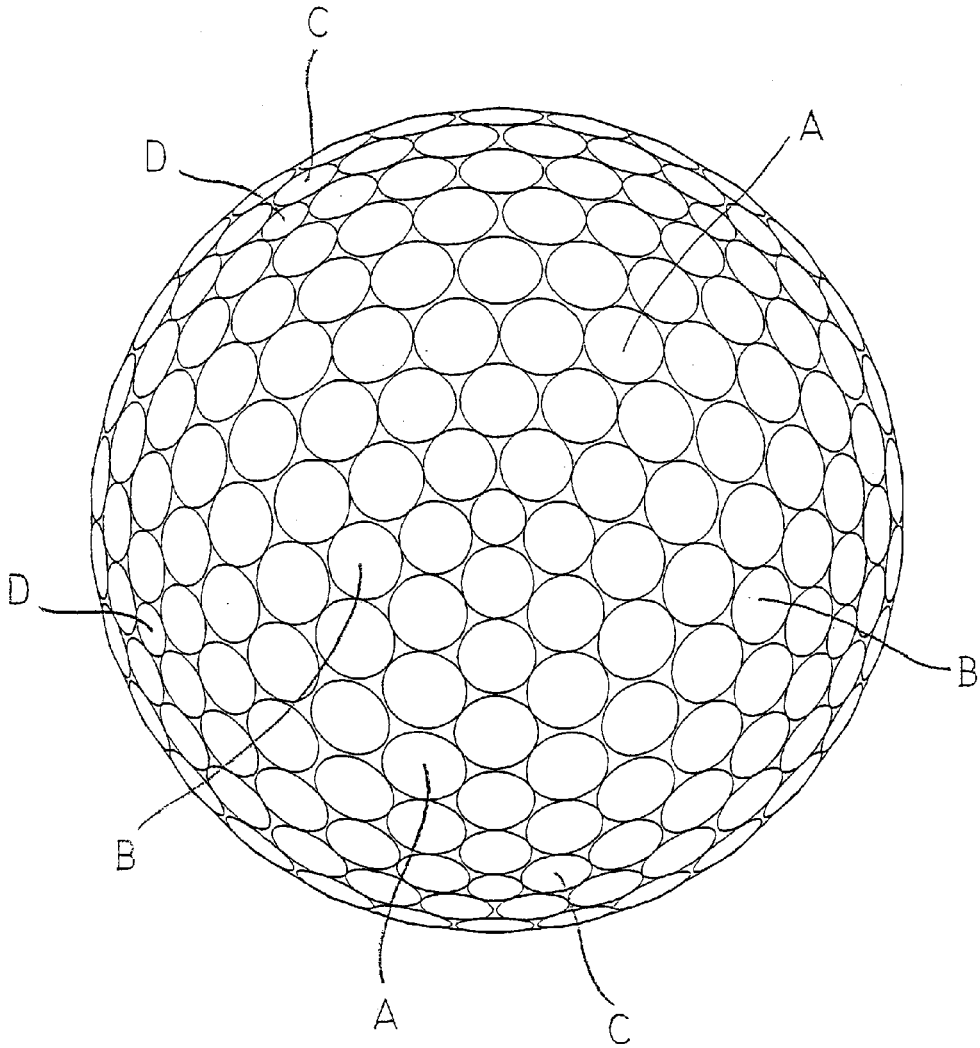
FIG. 9 is a plan view showing a golf ball according to an example 4 of the present invention.
Figure 10:
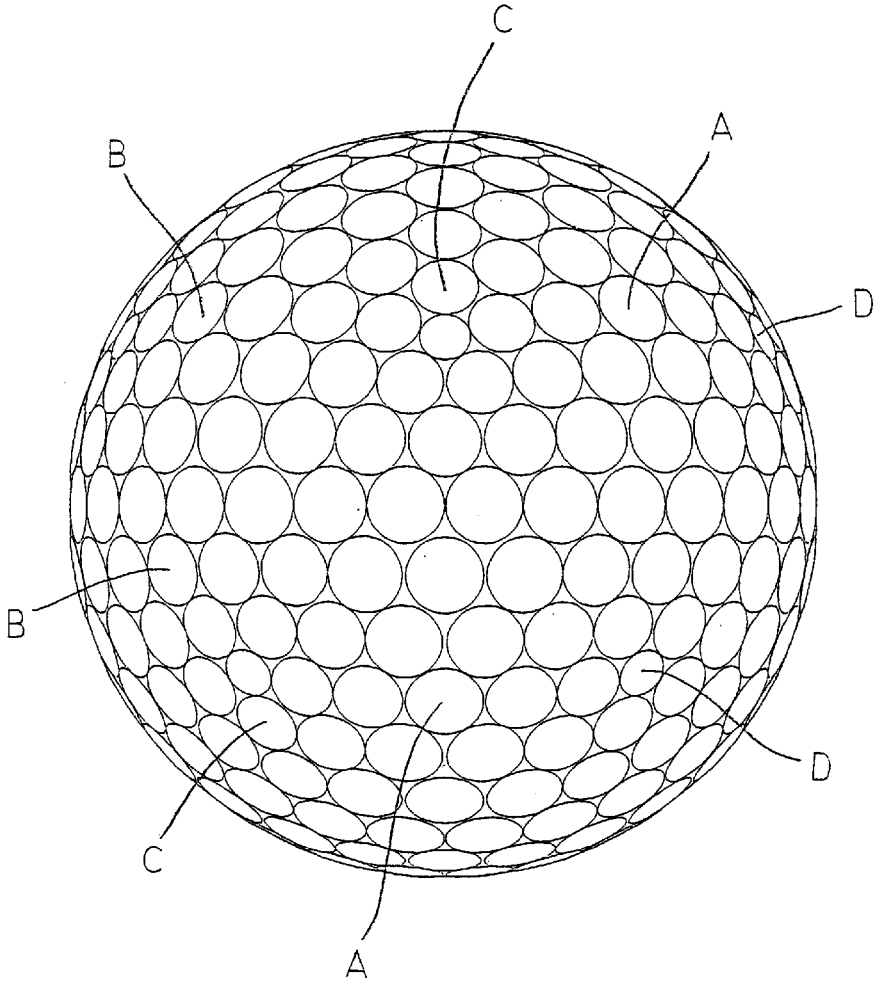
FIG. 10 is a front view showing the golf ball in FIG. 9.

A golf ball according to an example 4 which has a dimple pattern shown in a plan view of FIG. 9 and a front view of FIG. 10 was obtained in the same manner as in the example 1 except that the mold was changed. The golf ball includes 170 A dimples having a diameter of 4.4 mm, 120 B dimples having a diameter of 4.0 mm, 60 C dimples having a diameter of 3.8 mm, and 12 D dimples having a diameter of 2.5 mm. The golf ball has a total contour length X of 4668.4 mm and a surface area occupation ratio Y of 0.844. Accordingly, the golf ball satisfies the equation (II). In the golf ball, moreover, the number of dimples having a dimple contour length x of 10.5 mm or more is 96.7% of the total number of the dimples.

Example 5

Figure 11:
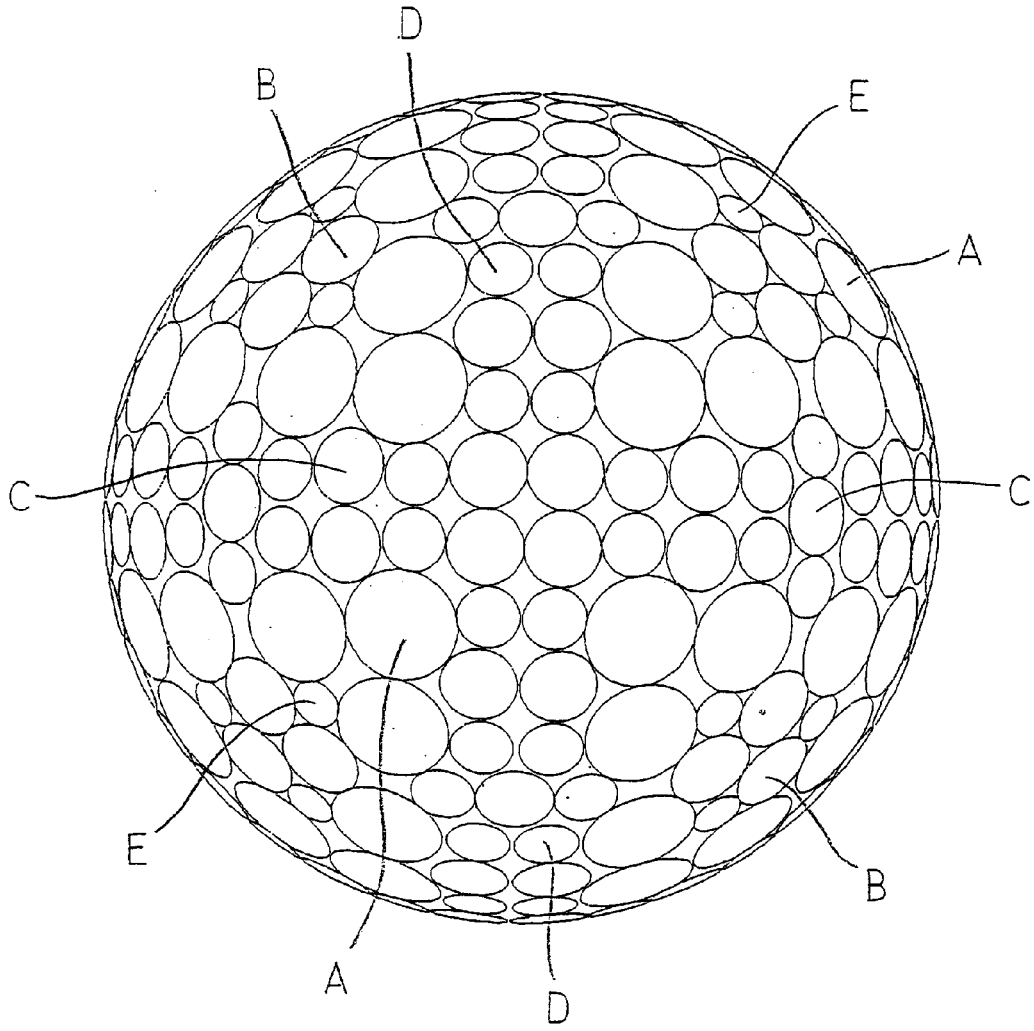
FIG. 11 is a plan view showing a golf ball according to an example 5 of the present invention.
Figure 12:
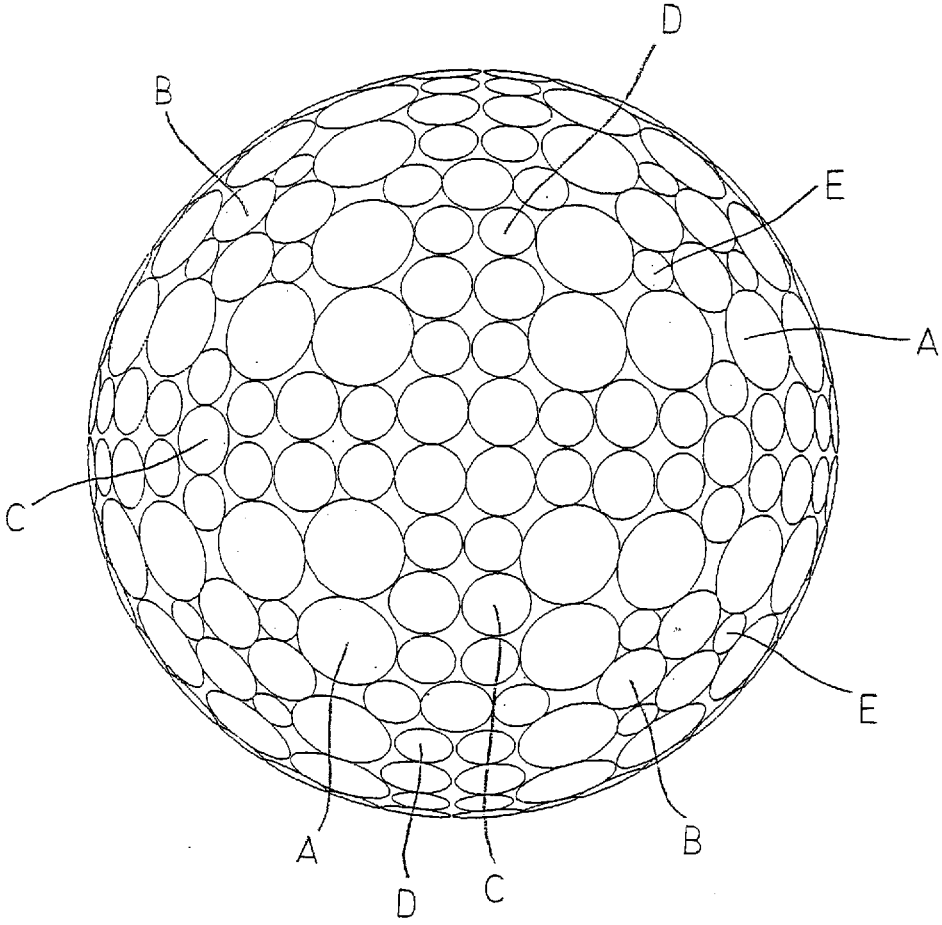
FIG. 12 is a front view showing the golf ball in FIG. 11.

A golf ball according to an example 5 which has a dimple pattern shown in a plan view of FIG. 11 and a front view of FIG. 12 was obtained in the same manner as in the example 1 except that the mold was changed. The golf ball includes 72 A dimples having a diameter of 6.0 mm, 24 B dimples having a diameter of 4.5 mm, 88 C dimples having a diameter of 4.0 mm, 112 D dimples having a diameter of 3.4 mm, and 24 E dimples having a diameter of 2.7 mm. The golf ball has a total contour length X of 4202.0 mm and a surface area occupation ratio Y of 0.817. Accordingly, the golf ball satisfies the equation (IV). In the golf ball, moreover, the number of dimples having a dimple contour length x of 10.5 mm or more is 92.5% of the total number of the dimples.

Comparative Example 1

Figure 13:
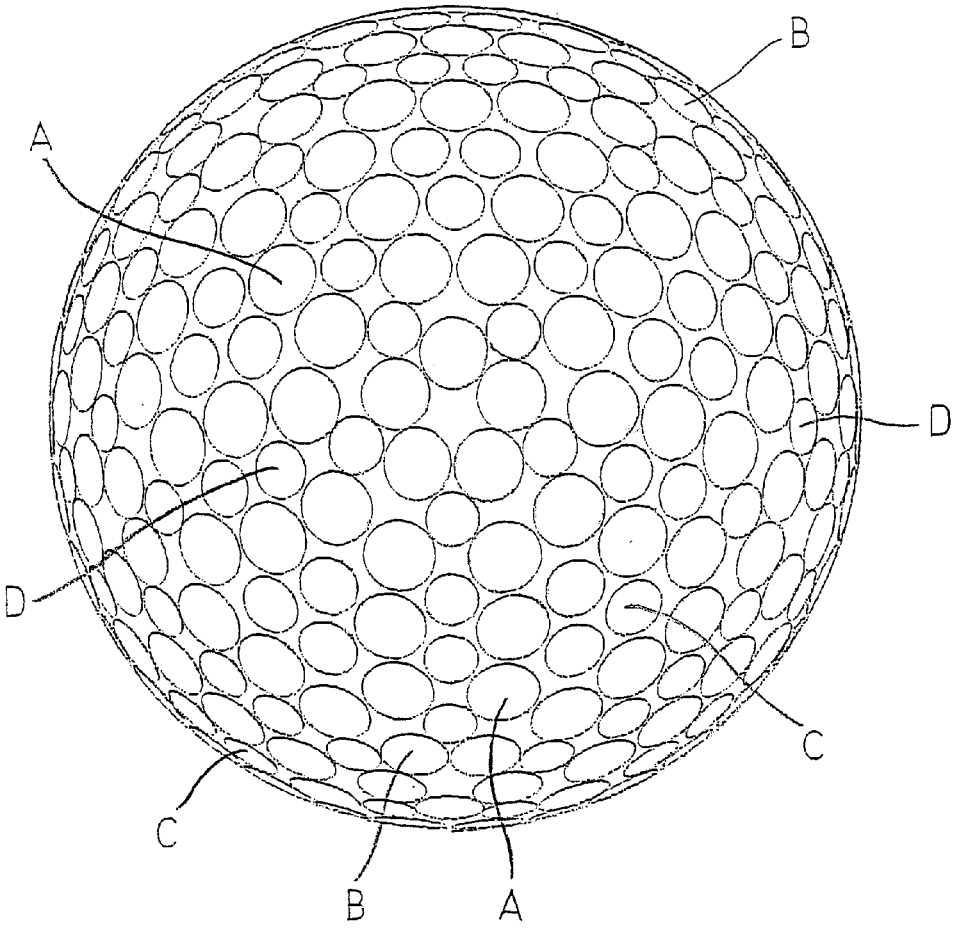
FIG. 13 is a plan view showing a golf ball according to a comparative example 1 according to the present invention.
Figure 14:
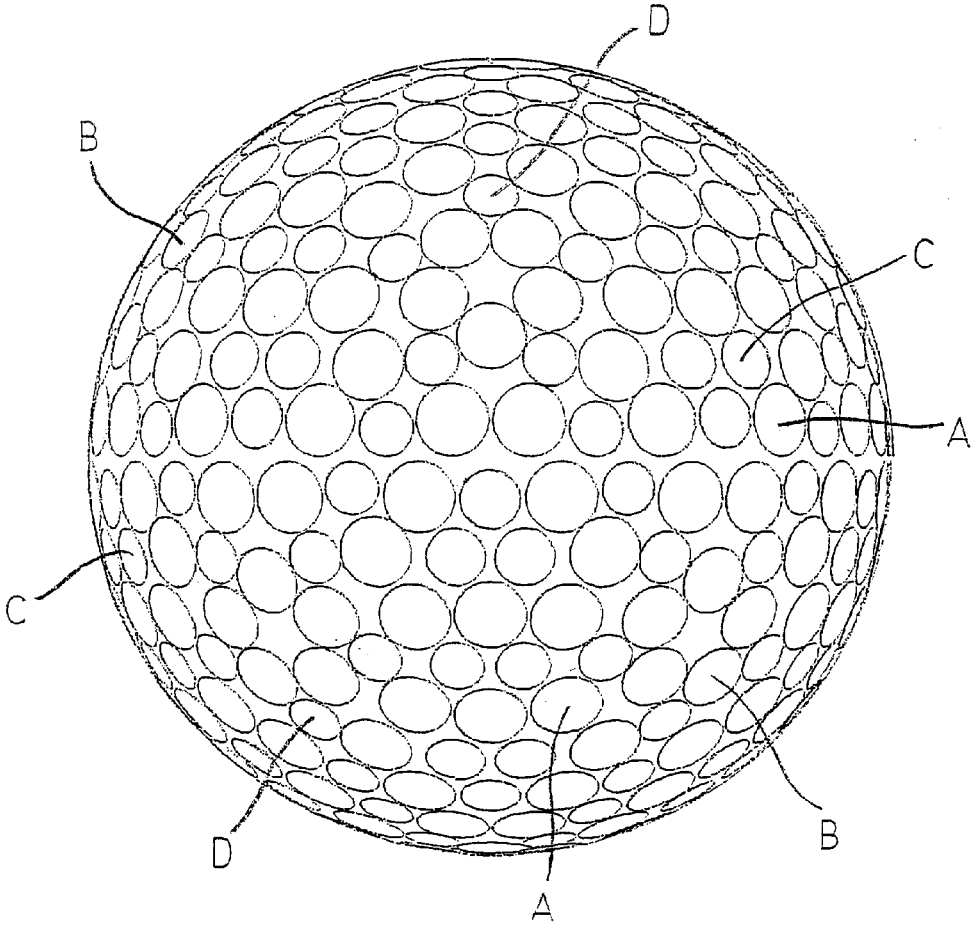
FIG. 14 is a front view showing the golf ball in FIG. 13.

A golf ball according to a comparative example 1 which has a dimple pattern shown in a plan view of FIG. 13 and a front view of FIG. 14 was obtained in the same manner as in the example 1 except that the mold was changed. The golf ball includes 180 A dimples having a diameter of 4.0 mm, 60 B dimples having a diameter of 3.8 mm, 60 C dimples having a diameter of 3.3 mm, and 120 D dimples having a diameter of 3.0 mm. The golf ball has a total contour length X of 4731.2 mm and a surface area occupation ratio Y of 0.751. Accordingly, the golf ball does not satisfy the equation (I). In the golf ball, moreover, the number of dimples having a dimple contour length x of 10.5 mm or more is 57.2% of the total number of the dimples.

Comparative Example 2

Figure 15:
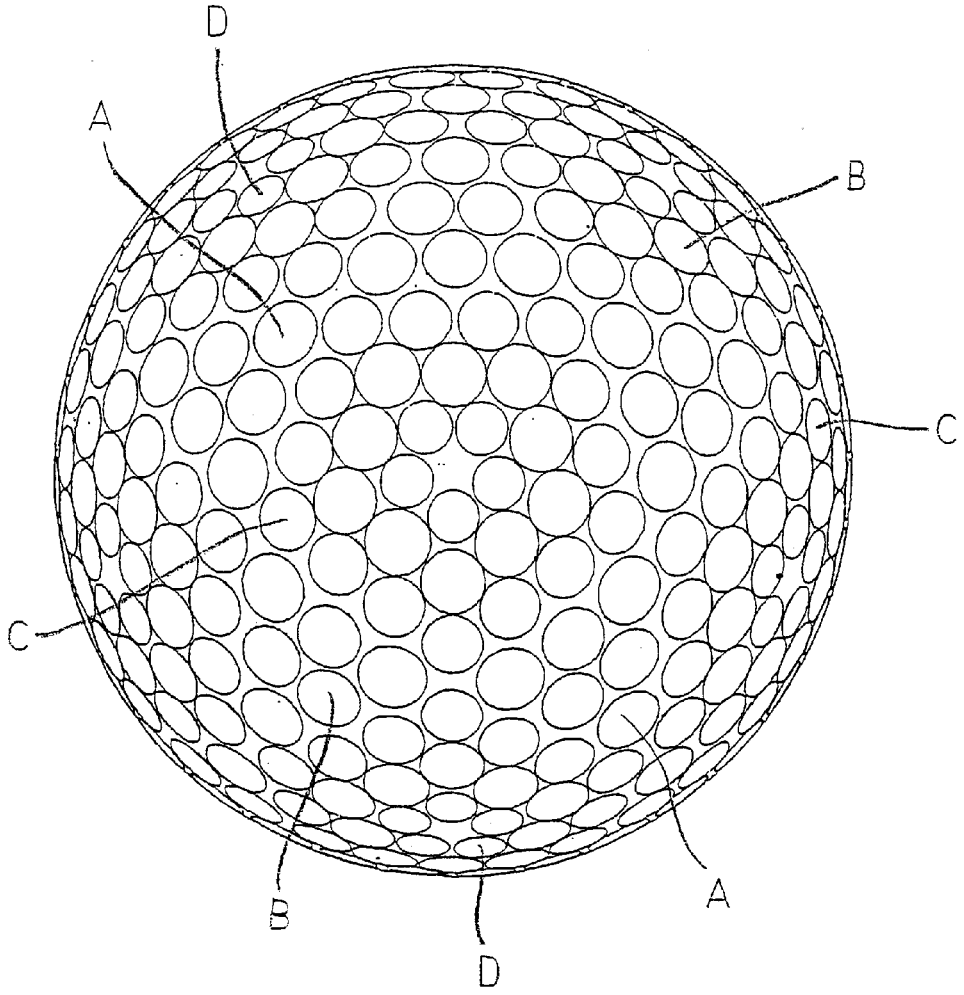
FIG. 15 is a plan view showing a golf ball according to a comparative example 2 of the present invention.
Figure 16:
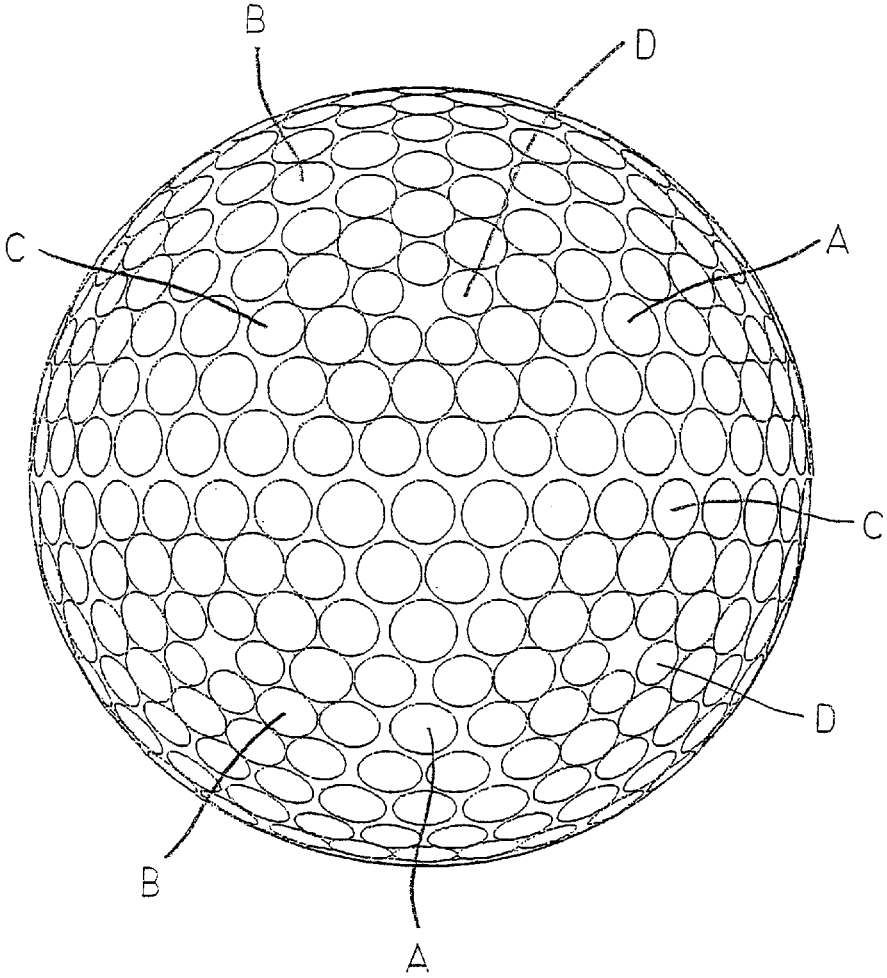
FIG. 16 is a front view showing the golf ball in FIG. 15.

A golf ball according to a comparative example 2 which has a dimple pattern shown in a plan view of FIG. 15 and a front view of FIG. 16 was obtained in the same manner as in the example 1 except that the mold was changed. The golf ball includes 60 A dimples having a diameter of 3.8 mm, 180 B dimples having a diameter of 3.6 mm, 180 C dimples having a diameter of 3.4 mm, and 60 D dimples having a diameter of 2.9 mm. The golf ball has a total contour length X of 5221.3 mm and a surface area occupation ratio Y of 0.793. Accordingly, the golf ball does not satisfy the equation (I). In the golf ball, moreover, the number of dimples having a dimple contour length x of 10.5 mm or more is 87.5% of the total number of the dimples.

Comparative Example 3

Figure 17:
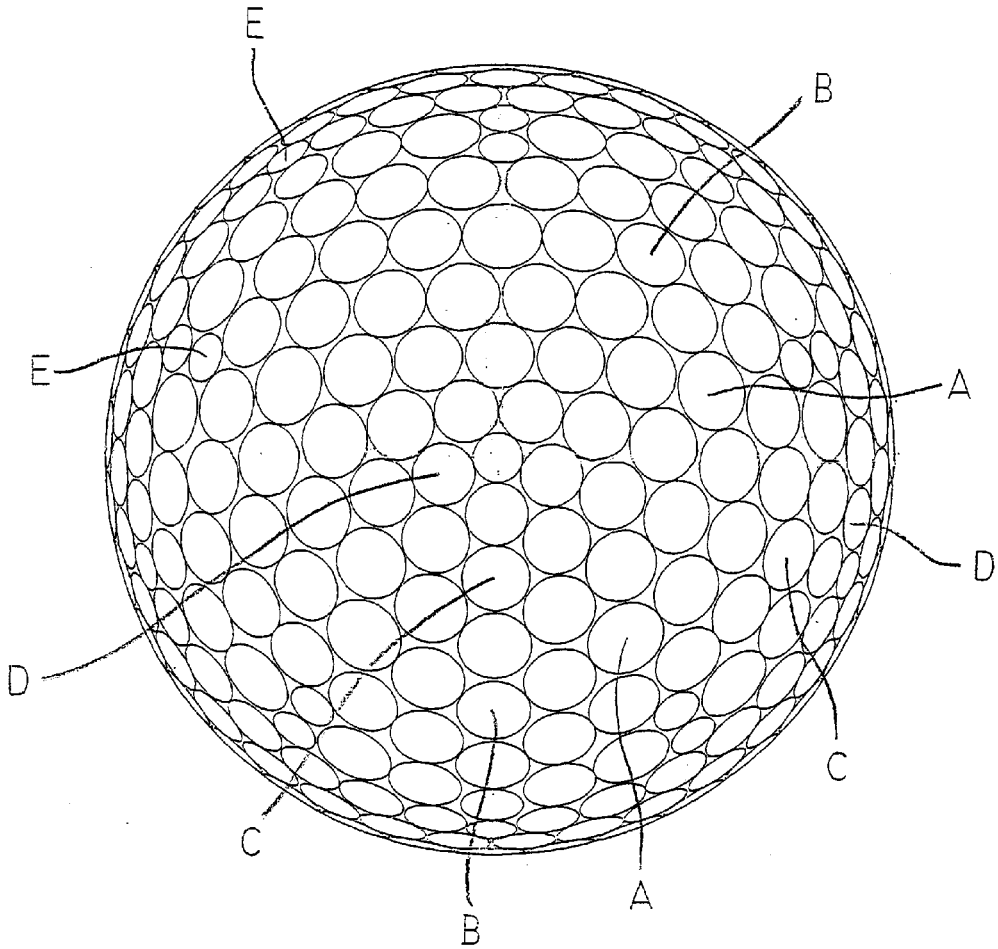
FIG. 17 is a plan view showing a golf ball according to a comparative example 3 of the present invention.
Figure 18:
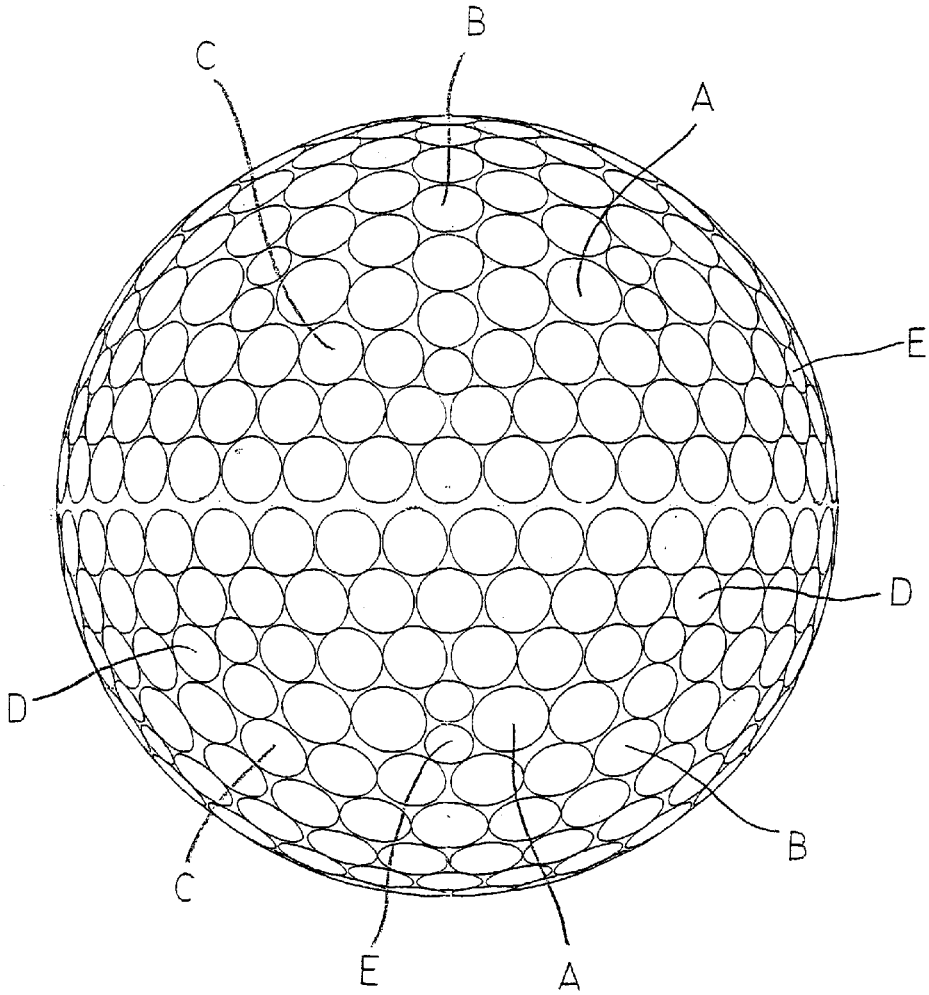
FIG. 18 is a front view showing the golf ball in FIG. 17.

A golf ball according to a comparative example 3 which has a dimple pattern shown in a plan view of FIG. 17 and a front view of FIG. 18 was obtained in the same manner as in the example 1 except that the mold was changed. The golf ball includes 30 A dimples having a diameter of 4.3 mm, 130 B dimples having a diameter of 4.0 mm, 180 C dimples having a diameter of 3.70 mm, 60 D dimples having a diameter of 3.4 mm, and 32 E dimples having a diameter of 2.8 mm. The golf ball has a total contour length X of 5053.6 mm and a surface area occupation ratio Y of 0.829. Accordingly, the golf ball does not satisfy the equation (I). In the golf ball, moreover, the number of dimples having a dimple contour length x of 10.5 mm or more is 92.6% of the total number of the dimples.

Flight Distance Test 20 golf balls according to each of the examples and the comparative examples were prepared and were maintained at 23° C. On the other hand, a driver comprising a metal head (trade name of "XXIOW#1" produced by Sumitomo Rubber Industries, Ltd., loft: 8 degrees, shaft hardness: X) was attached to a swing machine (produced by Golf Lab Co., Ltd.). Machine conditions were set to have a head speed of 50 m/sec, a back spin amount of approximately 2000 rpm obtained immediately after hitting and a launch angle of approximately 10 degrees, and the golf ball was hit and a total flight distance (a distance between a launch point and a stationary point) was measured. The following Table 1 shows the mean value of the results of measurement for the 20 golf balls.

TABLE 1

| | Result of evaluation of golf ball | | | | | | | | | | |
|---|---|---|---|---|---|---|---|---|---|---|---|
| | Dimple | | | | | | | | | | |
| | Kind | Dia (mm) | x (mm) | Number | Ratio (%) | Total | X (mm) | Y | Plan view | Front view | Distance (m) |
| Exa. 1 | A | 4.5 | 14.1 | 192 | 57.1 | 336 | 4297.7 | 0.775 | FIG. 1 | FIG. 2 | 255.2 |
| | B | 3.5 | 11.0 | 144 | 42.9 | | | | | | |
| Exa. 2 | A | 4.3 | 13.5 | 174 | 48.3 | 360 | 4495.6 | 0.786 | FIG. 5 | FIG. 6 | 253.3 |
| | B | 3.8 | 11.9 | 126 | 35.0 | | | | | | |
| | C | 3.4 | 10.7 | 60 | 16.7 | | | | | | |
| Exa. 3 | A | 4.4 | 13.8 | 130 | 34.9 | 372 | 4755.7 | 0.853 | FIG. 7 | FIG. 8 | 253.8 |
| | B | 4.1 | 12.9 | 150 | 40.3 | | | | | | |
| | C | 3.9 | 12.3 | 60 | 16.1 | | | | | | |
| | D | 2.9 | 9.1 | 32 | 8.6 | | | | | | |
| Exa. 4 | A | 4.4 | 13.8 | 170 | 47.0 | 362 | 4668.4 | 0.844 | FIG. 9 | FIG. 10 | 254.7 |
| | B | 4.0 | 12.6 | 120 | 33.1 | | | | | | |
| | C | 3.8 | 11.9 | 60 | 16.6 | | | | | | |
| | D | 2.5 | 7.9 | 12 | 3.3 | | | | | | |
| Exa. 5 | A | 6.0 | 18.8 | 72 | 22.5 | 320 | 4202.0 | 0.817 | FIG. 11 | FIG. 12 | 256.0 |
| | B | 4.5 | 14.1 | 24 | 7.5 | | | | | | |
| | C | 4.0 | 12.6 | 88 | 27.5 | | | | | | |
| | D | 3.4 | 10.7 | 112 | 35.0 | | | | | | |
| | E | 2.7 | 8.5 | 24 | 7.5 | | | | | | |
| Com. Exa. 1 | A | 4.0 | 12.6 | 180 | 42.9 | 420 | 4731.2 | 0.751 | FIG. 13 | FIG. 14 | 248.9 |
| | B | 3.8 | 11.9 | 60 | 14.3 | | | | | | |
| | C | 3.3 | 10.4 | 60 | 14.3 | | | | | | |
| | D | 3.0 | 9.4 | 120 | 28.6 | | | | | | |
| Com. Exa. 2 | A | 3.8 | 11.9 | 60 | 12.5 | 480 | 5221.3 | 0.793 | FIG. 15 | FIG. 16 | 245.1 |
| | B | 3.6 | 11.3 | 180 | 37.5 | | | | | | |
| | C | 3.4 | 10.7 | 180 | 37.5 | | | | | | |
| | D | 2.9 | 9.1 | 60 | 12.5 | | | | | | |
| Com. Exa. 3 | A | 4.3 | 13.5 | 30 | 6.9 | 432 | 5053.6 | 0.829 | FIG. 17 | FIG. 18 | 248.2 |
| | B | 4.0 | 12.6 | 130 | 30.1 | | | | | | |
| | C | 3.7 | 11.6 | 180 | 41.7 | | | | | | |
| | D | 3.4 | 10.7 | 60 | 13.9 | | | | | | |
| | E | 2.8 | 8.8 | 32 | 7.4 | | | | | | |

In the Table 1, the golf balls according to the examples 1 to 5 have greater flight distances than those of the golf balls according to the comparative examples 1 to 3. From the results of evaluation, the advantage of the present invention is apparent.

The above description is only illustrative and can be variously changed without departing from the scope of the present invention.

What is claimed is:

1. A golf ball having a large number of dimples on a surface thereof, and having a diameter of 42.67 mm to 43.00 mm, wherein the number of dimples having the dimple contour length x of 10.5 mm or more is 91% or more of a total number of the dimples, and X and Y satisfy the relationship of equation (I):

$$X \leqq 3882 \cdot Y + 1495 \quad \text{(I)},$$

wherein X represents a total of dimple contour lengths x; Y is from 0.775 to 0.853 and represents a surface area occupation ratio of the dimples.

2. A golf ball according to claim 1, wherein the surface area occupation ratio Y is from 0.786 to 0.844.

3. A golf ball according to claim 1, wherein X an Y satisfy the relationship of equation (III):

$$X \leqq 3882 \cdot Y + 1335 \quad \text{(III)}.$$

4. A golf ball according to claim 1, wherein the total contour length X is more than or equal to 2800 mm and less than or equal to 5000 mm.

5. A golf ball according to claim 4, wherein the total contour length X is more than or equal to 3100 mm and less than or equal to 4700 mm.

6. A golf ball according to claim 7, wherein the total contour length X is more than or equal to 4202.0 mm and less than or equal to 4755.7 mm.

7. A golf ball having large number of dimples on a surface thereof, and having a diameter of 42.67 mm to 43.00 mm, wherein X and Y satisfy the relationship of equation (IV):

$$X \leqq 3882 \cdot Y + 1085 \quad \text{(IV)},$$

wherein X represents a total of dimple contour length x; Y is from 0.70 to 0.90 and represents a surface area occupation ratio of the dimples.

* * * * *